US005078360A

United States Patent [19]

Spera

[11] Patent Number: 5,078,360

[45] Date of Patent: Jan. 7, 1992

[54] PREFABRICATED ASSEMBLY FOR POURED CONCRETE FORMING STRUCTURES

[75] Inventor: Vittorio Spera, St. Léonard, Canada

[73] Assignee: Speral Aluminium Inc., St. Leonard, Canada

[21] Appl. No.: 456,964

[22] Filed: Dec. 26, 1989

[51] Int. Cl.[5] ..... E04G 11/00; E04G 17/04

[52] U.S. Cl. ..... 249/26; 249/47; 249/48; 249/192; 249/219.1

[58] Field of Search ..... 249/47, 48, 192, 193, 249/219.1, 219.2, 26, 28, 44, 45, 160, 168, 191, 18

[56] References Cited

U.S. PATENT DOCUMENTS

| | | | |
|---|---|---|---|
| 1,540,570 | 6/1925 | Roberts | 249/219.1 |
| 1,588,229 | 6/1926 | Hotchkiss | 249/192 |
| 2,845,685 | 8/1958 | Lovgren et al. | 249/40 |
| 3,047,931 | 8/1962 | Boettner | 249/192 |
| 3,242,834 | 3/1966 | Sonheim | 249/219.1 |
| 3,601,356 | 8/1971 | Yurick | 249/192 |
| 3,603,557 | 7/1968 | Lind | 249/192 |
| 3,734,451 | 5/1973 | Tierney | 249/192 |
| 4,022,420 | 5/1977 | Pace | 249/194 |
| 4,158,452 | 6/1979 | Gates | 249/45 |
| 4,194,717 | 3/1980 | Easton et al. | 249/47 |
| 4,280,677 | 7/1981 | Shahar | 249/43 |
| 4,401,291 | 8/1983 | Gallis | 249/219.1 |
| 4,407,480 | 10/1983 | Trimmer et al. | 249/189 |
| 4,529,163 | 7/1985 | Dingler | 249/219.1 |
| 4,742,985 | 5/1988 | Mathis | 249/193 |
| 4,846,437 | 7/1989 | Fitzgerald | 249/3 |
| 4,886,234 | 12/1989 | Schworer et al. | 249/192 |
| 4,898,358 | 2/1990 | Spronken | 249/219.1 |

FOREIGN PATENT DOCUMENTS

| | | | |
|---|---|---|---|
| 495823 | 9/1950 | Belgium . | |
| 544320 | 9/1959 | Belgium . | |
| 637297 | 12/1963 | Belgium . | |
| 650382 | 11/1964 | Belgium . | |
| 0201887 | 11/1986 | European Pat. Off. . | |
| 1065769 | 9/1959 | Fed. Rep. of Germany | 249/48 |
| 2342093 | 3/1975 | Fed. Rep. of Germany | 249/192 |
| 8514233 | 4/1986 | Fed. Rep. of Germany . | |
| 1204869 | 1/1960 | France . | |
| 1270366 | of 1961 | France . | |
| 2231237 | 1/1975 | France | 249/192 |
| 629049 | 12/1961 | Italy | 249/219.1 |

OTHER PUBLICATIONS

Precise Trimform Catalog, Precise Forms, Inc.
Precise Forms, Precise Forms, Inc.

*Primary Examiner*—Jay H. Woo
*Assistant Examiner*—Khanh P. Nguyen
*Attorney, Agent, or Firm*—Shlesinger, Arkwright & Garvey

[57] ABSTRACT

There is provided a modular assembly for poured concrete forming, including a plurality of interconnecting rigid panel members having a rear portion and front facing for contact with poured concrete to form a mold surface. The rear portion of the panel members provides at least two flanges extending generally rearwardly of the front facing, each of the flanges being longitudinally disposed respectively adjacent each of at least two opposed terminal edges of the panel members. Adjacent the front facing of the panel members, a stepped portion is provided at one of the terminal edges of the panels, and a corresponding protruding edge portion is provided at the other of its terminal edges thereof for intimate engagement with the stepped portion of an abutting panel member. The flanges of the panels each provides a mating surface for abutment in intimate contact with an adjacent flange of an abutting panel member. The flanges are adapted for releasably retaining a locking member for securing two abutting panel members. The locking member may be a key member received in slots respectively provided in adjacent flanges of two abutting panels. Alternatively, the locking member may be in the form of a clamp member or scissor type member for engagement with the flanges adjacent longitudinally extending lip members provided at the free terminal ends of the flanges for retaining such locking members.

27 Claims, 8 Drawing Sheets

PREFABRICATED ASSEMBLY FOR POURED CONCRETE FORMING STRUCTURES

FIELD OF THE INVENTION

The present invention relates generally to the tield of concrete forming structures and more particularly, to a system of interconnecting modular panels for assembling a variety of concrete forming structures, which structures are especially suited to tbe construction of walls, columns and pillars or the like.

BACKGROUND OF THE INVENTION

Conventionally, it has been known in the field of huilding construction to provide concrete forming structures for floors, walls, columns and pillars or tbe like comprising plywood or other wooden sheeting for surface contact with the poured concrete. Such forming structures support the newly-poured concrete walls or columns throughout the curing period of the concrete, which may typically be of the order of several days.

The known concrete forming structures generally include a plurality of individual plywood sheets to form a molding surface or facing against which the concrete is to be poured, the sheets being fastened or otherwise secured to a framing structure which may comprise a number of structural elements such as load-bearing timbers, beams or joists, as is well known to these skilled in this art. In the case of a typical wall form, the structural elements therefor comprise a plurality of vertical studs to which the sheeting is nailed or otherwise secured, the studs being in turn backed-up by a plurality of horizontal waler members. In many cases, the conventional wall forms further require a plurality of tie rods or the like which are disposed hetween the parallel faces of the assembled form and are intended to provide greater structural integrity to the forming structure.

The prior art forms of the type discussed above are generally custom made to suit a particular concrete pouring operation, thereby requiring considerable cutting and fitting of the numerous constituent parts of the forming structure and calling for either skilled or semi-skilled labour for the assembly thereof. Once the concrete poured therein has set, these known forms are dismantled and stripped away from the hardened concrete, resulting in a substantial amount of ruined lumber parts and metal fittings or fasteners which cannot be reused in subsequent concrete forming operations. It may therefore be appreciated that the of conventional concrete pouring structures, characterized by formwork constructed from timber, is cost intensive from the perspective of both labour and materials.

A number of concrete pouring systems consisting of prefabricated component parts have been developed over the years in an attempt to alleviate the various problems associated with the conventional job-dedicated concrete structures described above. However, some such concrete pouring systems do not entirely eliminate the use of non-reusable components. Furthermore, the component parts of known prefabricated formwork systems may on occasion include steel panel facings or steel structural members, thereby resulting in heavy and cumbersome concrete forming structures. Moreover, some such prefabricated formwork systems require numerous pieces of hardware such as nails, bolts, ties, wedges, clamps and the like for assembly, which hardward may not necessarily be reusable. Other systems of this prefabricated type are composed of a rather large number of constituent parts which necessitates that manufacturers, suppliers or users thereof stock an excessive inventory in order to be able to assemble a broad variety of concrete forming structures for the commonly encountered sizes of walls or columns, for instance.

In yet other known prefabricated concrete forming systems, assembly and disassembly of the various constituent components is both difficult and time consuming. In addition, some of the known systems do not adequately provide for aoourate alignment of the modular elements thereof, with the result that offsets, e.g. ridges, creases or other like markings, are formed in the finished concrete from panel members which do not properly align at their joints. Still other prefahricated systems of the prior art comprise modular elements which are rather bulky, and these sys ems are hence difficult to store and to transport to the work site, even in unassembled form.

It is accordingly one object of the present invention to provide a system of interconnecting modular panels for assembling a broad variety of concrete forming structures, wherein all of the component parts thereof and securing means therefor can be reused in subsequent concrete forming operations.

It is another object of the present invention to provide a modular assembly for concrete forming structures wherein the modular elements thereof consist of a rather reduced number of constituent parts, such that manufacturers, suppliers or users of the present invention need not stock an excessive inventory in order to be able to assemble the commonly encountered sizes and configurations of pouring structures in the construction field.

It is a further object of the invention to provide a system of prefabricated components f or a concrete pouring structure which is fast and easy to assemble and to subsequently disassemble once concrete poured therein has set, and which may be assembled or disassembled by semi-skilled or unskilled labour a the construction or building site.

It is vet another object of the invention to provide a modular assembly for concrete forming which ensures acourate alignment to the modular elements thereof so that offsets or other imperfections may be avoided in the finished conorete surfaces.

It is yet another object of the present invention to provide a prefabricated system for concrete forming structures comprising relatively compact modular elements which may be conveniently stored and transported to the work site.

Still a further object of the invention is to provide a modular assembly for concrete forming whose constituent parts are amenable to manufacture by aluminium die extrusion processes, therehy resulting in relatively lightweight, strong and rigid modular elements therefor.

SUMMARY OF THE INVENTION

According to a first broad aspect of the present invention, there is provided a modular assembly for poured concrete forming, said assembly comprising a plurality of interconnecting rigid panel members and releasable locking members therefor, said panel members and said locking members each being integrally formed; said panel members having a rear portion thereof and a front facing for contact with poured concrete to form a mold surface therefor; said rear portion of the panel members providing at least two flange members etending generally rearwardly of said front facing, each of said flange members being longitudinally disposed respectively adjacent each of at least two opposed terminal edges of the said panel members; said panel members, adjacent said front facing, further providing a stepped portion at one of said terminal edges thereof, and a corresponding protruding edge portion at the other of said terminal edges thereof for intimage engagement with the said stepped portion of an abutting panel member; each of the said flange members providing a mating surface for abutment in intimate contact with an adjacent flange member of an abutting panel member, each of said flange membes further providing receiving means for releasably retaining a said locking member for securing two abutting panel members of said assembly, said receiving means comprising a slotted guide means for releasably retaining a said locking member in slip-fit engagement, said guide means being formed by the superposition of two communicating slots respectively provided in said adjacent flange members of two abutting panel members, said slots being generally L-shaped and each comprising first and second slot segments, said first slot segment being open to the rear portion of said panel members and extending generally towards the said front facing thereof, said second slot segment communicating with said first slot segment and being disposed in a direction substantially parallel to the front facing of said panel members.

According to a second broad aspect of the present invention, there is provided a modular assembly for poured concrete forming, said assembly comprising a plurality of interconnecting rigid panel members and releasable locking members therefor, said panel members having a rear portion thereof and a front facing for contact with poured concrete to form a mold surface therefor; said rear portion of the panel members providing at least two flange members extending generally rearwardly of said front facing, each of said flange members being longitudinally disposed respectivelyadjacent each of at least two opposed terminal edges of the said panel members; said panel members, adjacent said front facing, further providing a stepped portion at one of said terminal edgers thereof, and a corresponding protruding edge portion at the other of said terminal edges thereof for intimate engagement with the said stepped portion of an abutting panel member; each of the said flange membes providing a mating surface for abutment in intimate contact with an adjacent flange member of an abutting panel member, each of the said flange members further providing a slotted guide means for releasably retaining a said locking member in a slip-fit engagement for securing two abutting panel members of said assembly, said guide means being formed by the superposition of two communicating slots respectively provided in said adjacent flange members of two abutting panel members, said slots being generally L-shaped and comprising first and second slot segments, said first slot segment being open to the rear portion o said panel members and extending generally towards the said front facing thereof, said second slot segment communicating with said first slot segment and being disposed in a direction substantially parallel to the front facing of said panel members.

According ot a third broad aspect of the present invention, there is provided a modular assembly for poured concrete forming, said assembly comprising a plurality of interconnecting rigid panel members and releasable locking members therefor; said panel members having a rear portion thereof and a front facing for contact with poured concrete to form a mold surface therefor; said rear portion of the panel members providing at least two flange members extending generally rearwardly of said front facing, each of said flange members being longitudinally disposed respectively adjacent each of at least two opposed terminal edges of the said panel members to thereby form a mating surface for abutment in intimate contact with an adjacent mating surface of an abutting panel member; each of said flange members further providing receiving means for releasably retaining a said locking member for securing two abutting panel members of said assembly; wherein said receiving means comprises a slotted guide means for releasably retaining a said locking member in slidable drop-fit engagement therewith, said guide means being formed by the juxtaposition of two communicating slots respectively provided in said adjacent flange members of two abutting panel members, each of said slots being open to the rear portion of said panel members, said slots commencing in a direction extending generally towards the said front facing of said panel members and terminating in a direction substantially parallel to the front facing of said panel members.

BRIEF DESCRIPTION OF THE DRAWINGS

For purposes of illustration, but not of limitation, embodiments of the present invention are described hereinbelow with reference to the following drawings in which.

DETAILED DESCRIPTION OF THE PREFERRED EMBODIMENTS

Figure 1:
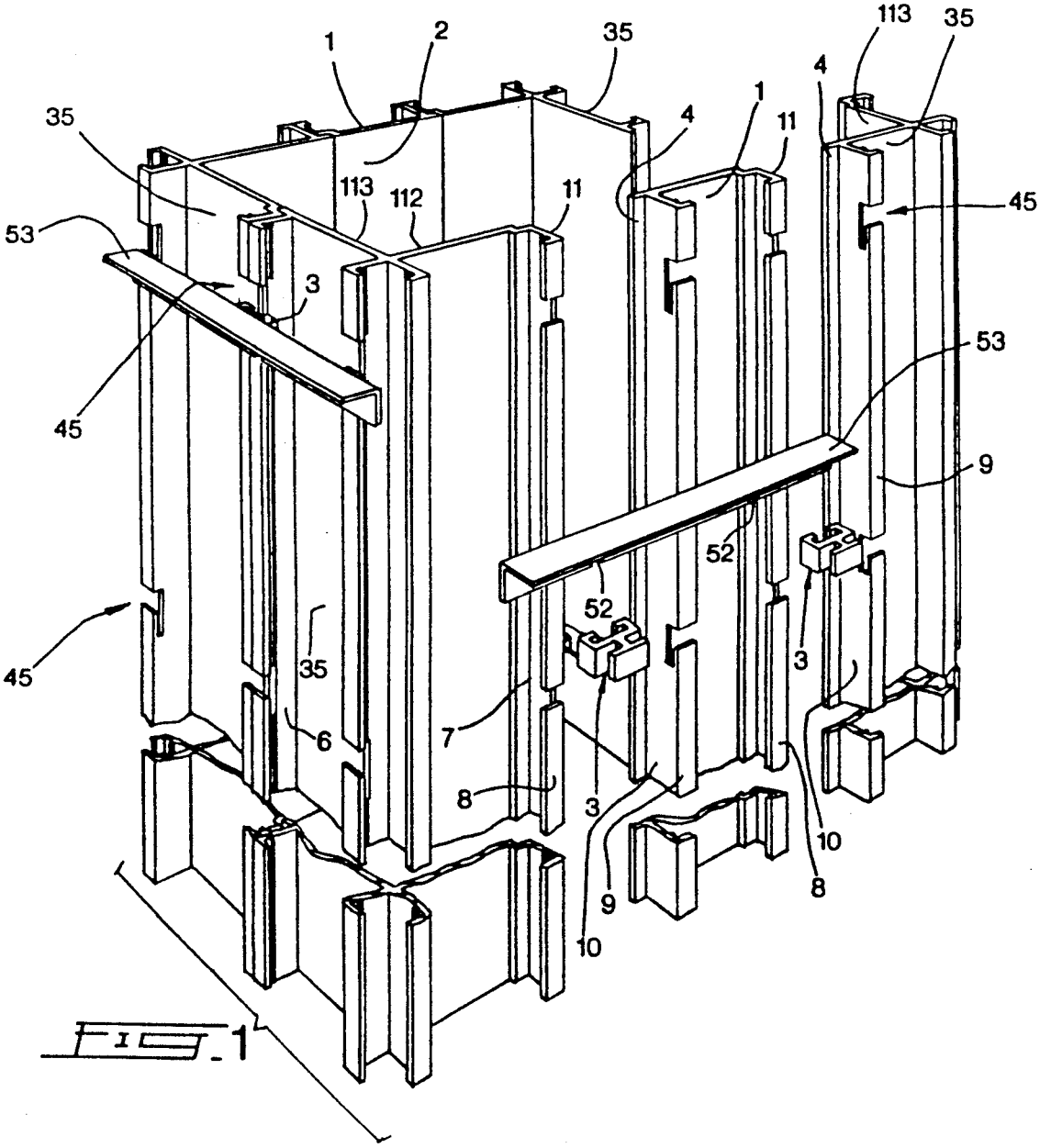
FIG. 1 is a partially exploded and sectioned perspective view of the modular assembly for poured concrete forming according to the present invention, wherein the components thereof have been assembled for the pouring of a typical concrete column or the like, and showing a plurality of elongate connectable panel members, a plurality of locking key members for securing two abutting panel members, and waler members for connecting a desired number of horizontally aligned adjacent locking key members.
Figure 5A:
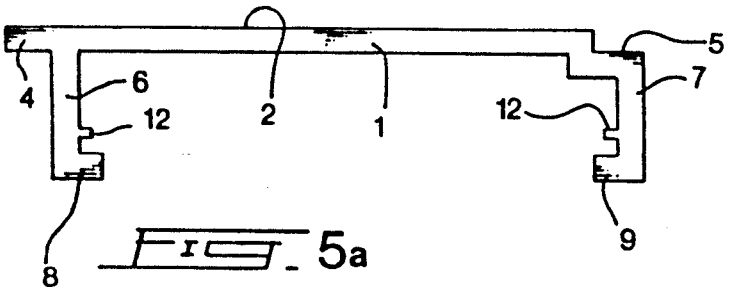
FIGS. 5*a* to 5*d* depict plan views of various sizes and configurations for straight-line panel members of the type illustrated in FIGS. 1 and 2.
Figure 5B:
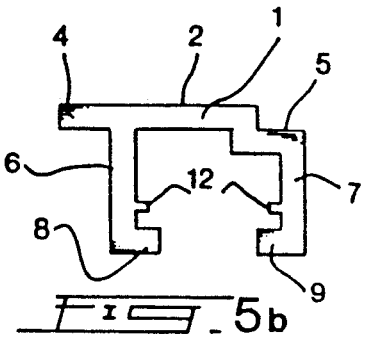
Figure 5C:
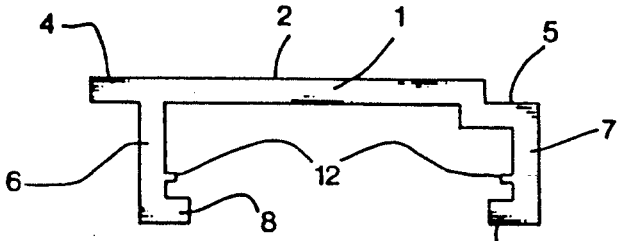
Figure 5D:
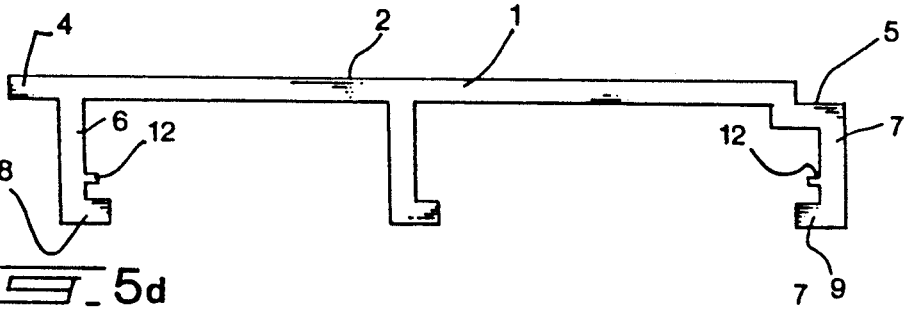

As shown in FIG. 1 for a typical arrangement, the prefabricated assembly for a concrete forming structure according to the present invention comprises a plurality of interconnecting elongate modular panel members 1 which are preferably adapted for connection in an edge-to-edge upstanding contiguration. Wben so connected, the members 1 define a substantially planar concrete forming surface 2, as shown in the particular configuration of FIG. 1 for the pouring of a concrete column or pillar. Each member 1 is preferahly composed of a structurally suitable aluminum alloy, such as 6351-T6 or the like, and may advantageously be formed by well-known die extrusion processes. In this manner, the modular panels may be fabricated in standard lengths, for example with 8 or 12-foot extruded stock, which lengths are adapted respectively for the forming of concrete walls or columns in typical high-rise residential and commercial buildings. For other uses, the standard length modular panels may easily be cut to size for a particular application, for instance, by a workman at the construction site.

The panel members 1 may be provided in a number of sizes or configurations for assembling the various concrete forming structures normally encountered in the construction field. The modular panel members 1 according to the present invention may also be provided in a finite number of fixed and relatively narrow widths, for instance 2", 4", 6", 8" and 10", so as to enable the construction of numerous forming structures. In this versatile manner, the panel members are adapted for assembly to virtually any dimension or configuration of wall or pillar encountered in the building field while at the same time permitting manufacturers, suppliers or users of such panels to stock a reduced inventory of sizes.

As described in greater detail hereinhelow, panel members 1 are secured toqether by means of a plurality of locking key members 3 which each secure two adjacent panels of the assembly. The key members 3 are received in corresponding slotted guide means 45, which are preferably disposed along the lengths of two adjacent panels in a vertically spaced apart relationship. A plurality of horizontally adjacent locking key members 3 for a series of abutting panels along one faoe of the assembly may in turn be interconnected by means of an elongate angled waler member 53 in order to generally improve the structural strength and resistance to flexing of the concrete forming assembly.

Figure 2:
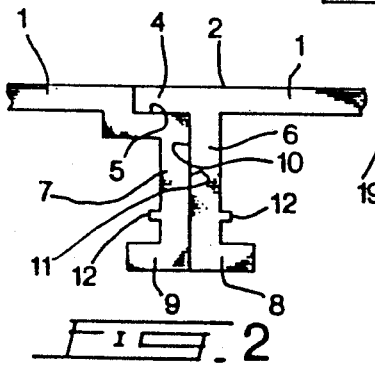
FIG. 2 is a plan view of two abutting panel members of the type depicted in FIG. 1, having a T-shaped configuration opposite the front facing of the panel members at the free terminal ends of the flange members thereof.
Figure 3:
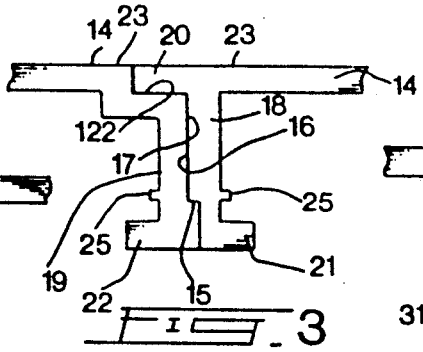
FIG. 3 is a plan view of another embodiment for panel members according to the present invention, wherein a second stepped contact surface is provided at the abutting surfaces of the flange members of the panel members.
Figure 4:
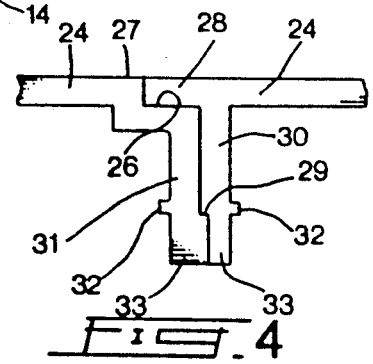
FIG. 4 is a plan view of yet another embodiment ofthe panel memhers according to the present invention, similar to the panel members of FIG. 3, but wherein no T-shaped configuration is provided opposite the front facing of the panel members and at the free terminal ends of the flange members thereof.

Referring now in particular to FIGS. 2, 3 and 4 of the drawings, the panel members 1 each provide, adjacent the forming surface 2 of .he panel, a protruding edge portion 4 for intimate engagement with a corresponding stepped surface 5 of an immediately abutting panel. Each of the straight-line panel members 1 further provides at least two transverse flange members 6,7 having generally L-shaped and reversed L-shaped respective configurations, such that the two flange members provide an inwardly extending and opposed pair of lip members 8,9 substantially parallel to the forming surface 2 of the panel. The flanqe members 6,7 and lip members 8,9 thereby provide a generally T-shaped configuration at the rear portion of two adjoining panel members 1. A fin 12, longitudinally extending the entire length of the panels, is provided on each of the transverse flange members 6,7 adjacent the lip members 8,9 thereof, for the purposes described in 9reater detail hereinbelow.

As for the corner panel members such as those denoted by reference characters 35 of FIG. 1, a pair of like transverse flanqe members 6,7 are provided, each one being transverse to one of the respective forming surfaces 112,113 of the panels, which forming surfaces are generally perpendicular in the specific embodiment of the corner panel members 35 illustrated therein. The flange members 6,7 in the case of corner panel members 35 provide respective lip members 8,9 which each extend generally towards the corner 104 (FIG. 6*b*) of said panel members. Flange members 106 and 107, each having a generally L-shaped cross sectional configuration, may be provided adjacent the corner 104 of the panel members for the purpose to be described in greater detail hereinbelow.

The transverse flange members 6,7 of each panel provide respective mating surfaces 10,11 adapted for intimate contact with the corresponding opposed surfaces of adjoining panels. The combination of the engaging protruding edge and stepped portions 4,5 adjacent the forming surface 2 of the panels described above with that of the contacting mating surfaces 10,11 of the transverse flange members thereof, provides for a simple, efficient and secure arrangement for assembling the modular panels in a defined and desired configuration. Moreover, following the setting of concrete in an assembled form, the said arrangement is well suited to easy and rapid disassembly without causing excessive wear or damage of any kind to the modular form, which may then be reused in another concrete forming operation.

FIGS. 3 and 4 illustrate two other embodiments of the panel members according to the present invention. In FIG. 3, the panel members 14 have generally the same configuration as panel members 1 described ahove. except that a second stepped surface 15 is provided at the respective mating surfaces 16,17 of the flanqe members 18,19 of two adjacent panel members I4. As is the case for the embodiments shown in FIGS. 1 and 2, a stepped portion 122 is provided on each panel member 14 adjacent front facing 23 thereof for intima.e engagement with a protruding edge portion 20 of said panels. Analogously, two transverse flange members 18,19 are provided thereon, each respectively having a lip member 21, 22 extending therefrom. Furthermore, fins 25 extend longitudinally the entire length of the panels, as described previously.

In the particular embodiment of FIG. 3, both of the stepped portions 15 and 122 are substantially parallel so that the panel members 14 may be easily dismantled once concrete formed thereby has sufficiently set. It is to be noted that the panel members according to the present invention are easily knocked-down even where a wall or pillar is to be poured between the upper and lower slabs of two adjacent floors in a building. The panel members 14, as is the case with panel members 1, provide lip members 21,22 for the respective flange portions 18,19, said lip portions being provided at the terminal ends of said flange portions opposite the mold facing 23 of the forms, to thereby provide a generally T-shaped configuration at the rear portion of the forms.

Turning now to FIG. 4, there is shown yet another embodiment of the panel members according to the present invention. The panel members 24 according to this embodiment are similar to those of the type illustrated in FIG. 3, providing a stepped portion 26 adjacent the front facing 27 of the form for engagement with a protruding edge portion 28 thereof, and further providing a second stepped surface 29 at the mating surfaces of the two adjacent flange members 30,31. However, the free terminal ends 33 of the flange members, opposite the front facing 27 of the forms, do not provide lip members as do the embodiments of the panel members of FIGS. 1 to 3. In this particular embodiment, longitudinal fins 32 as previously described are provided adjacent the squared free terminal ends 33 of the flange members 30,31.

FIGS. 5*a* to 5*d* show various sizes and configurations of straiqht-line panel members 1 aooordng to the embodiment described in FIGS. 1 and 2. Typically, these forms are provided in 8-foot to 12-foot lengths and in a finite number of incremental widths, the maximum width of the forms when same are extruded being dictated only by the currently prevailing technical constraints associated with die extrusion processes. However, it will be appreciated that no such constraints as to the panel member width should exist when the members are not integrally extruded but are formed by other means Well known to those skill in this art.

Figure 6A:
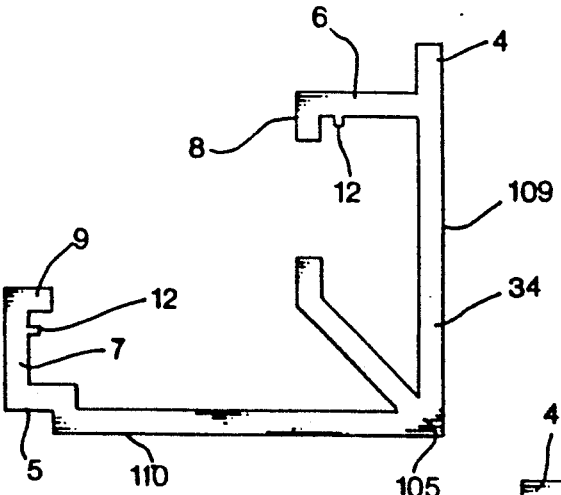
FIGS. 6*a* and 6*b* are plan views showing, respectively, an inside corner panel member and an outside corner panel member for use with the panel members of the type illustrated in FIGS. 1, 2 and 5.
Figure 6B:
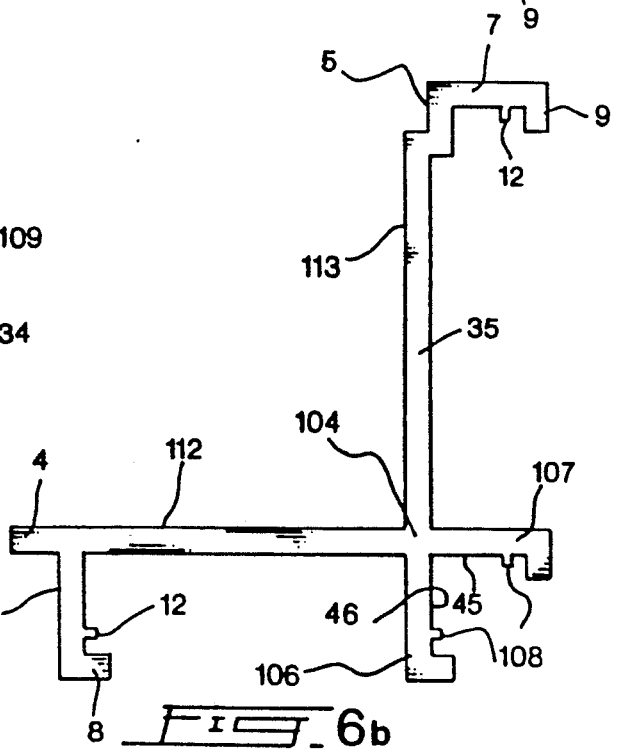

FIGS. 6*a* and 6*b* illustrate two corner sections 34 and 35 for use with the present invention. In FIG. 6*a*, the panel member 34 is intended for forming an inside corner The panel member 34, as is the case with the straight-line panel members 1, provides a stepped portion 5 and a protruding edge portion 4 for interconnection with said straight-line panel members as descrihed above. For such inside cerner members 34, a pair of transverse flange members 6,7 are respectively provided rearwardly of each of the generally perpendicular forming surfaces 109,110 of the panels, with the respective lip memhers 8,9 provided on said flange members extending generally towards the corner 105 of the panel members 34.

In FIG. 6*b*, the panel member 35 is intended for forming an outside corner in a wall or pillar type construction. As already described in relation to FIG. 1, panel member 35 provides the stepped surface and corresponding protruding edge arrangement for interconnection with other modular panel members according to the present invention.

Figure 7:
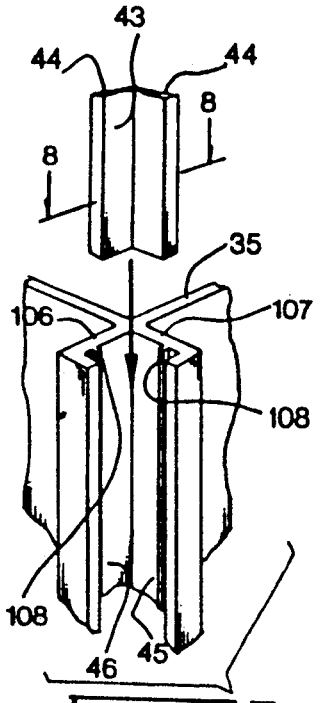
FIGURE 7 is a perspective view of a reinforcing section for use with the outside corner member of the type shown in FIG. 6*b;*
Figure 8:
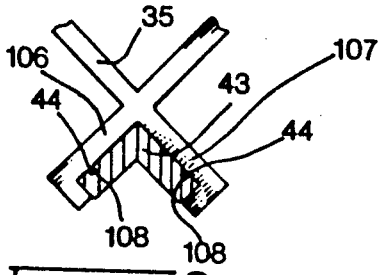
FIG. 8 is a cross sectional view of the reinforcing member and outside corner member, taken along line 8—8 of FIG. 7.

FIGS. 7 and 8 illustrate a reinforcing section 43 in the form of an elongate and generally L-shaped member having two channels 44 longitudinally extending the entire length thereof. The reinforcing member 43 is adapted for slip-fit engagement with the two opposing surfaces 45,46 of flanges 106,107 of an outside corner member of the type illustrated in FIG. 6*b*, the longitudinal channels 44 receiving the fins 108 therein for providing an intimate and secure slip-fit engagement of the corner member 35 and the reinforcing section 43. It will be apparent to those skilled in this art that the reinforcing section 43 will be preferably used with corner member 35 wherever added structural integrity is desired, for instance, when pouring very large concrete columns or walls.

Figure 9:
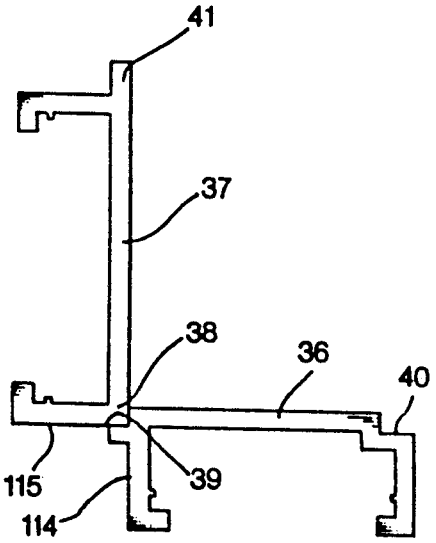
FIG. 9 is a top plan view which shows another embodiment ior a corner section of a concrete pcuring assembly according to the present invention, wherein two panels are provided for assembling a corner configuration.

FIG. 9 shows another embodiment for a corner section of a concrete pouring form, wherein two panels 36,37 are provided for assemhling a corner configuration. panel member 37 is a straight-line section of similar construction to the panel members illustrated in FIGS. 5*a* to 5*d*, with the notable exception that no stepped surface 5 is provided thereon. Rather, one end 38 of panel member 37 is adapted for intimate engagement with a stepped portion 39 of the abutting panel member 36. The other end of panel member 37 provides a protruding edge 41 as was described hereinabove for other embodiments of the panel members. One end of panel member 36 correspondingly provides a stepped portion 40 which is of identical construction to the stepped portion 5 of panel members 1.

Figure 10:
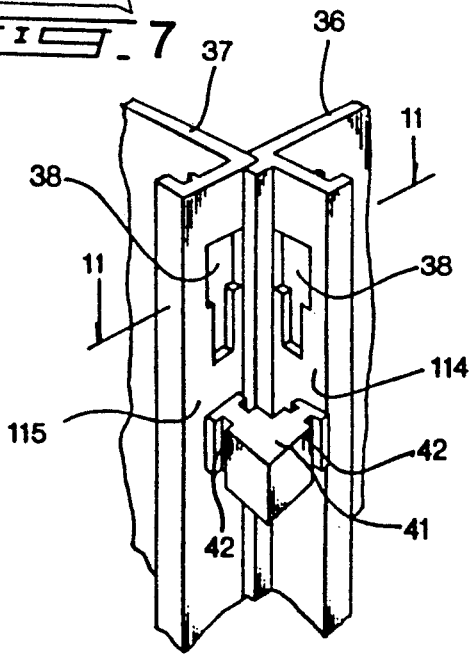
FIG. 10 is a partial perspective view of paired keyways provided on two adjacent outer suriaces of the corner section panels of FIG. 9, wherein a key memher is shown for engagement with the keyways, said key member securing the connection of said two adjacent panels.
Figure 11:
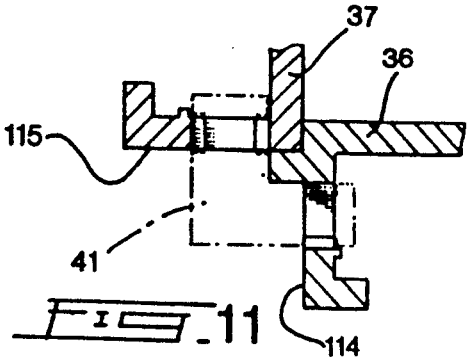
FIG. 11 is a top plan view of an inserted key member shown in dotted lines, taken along line 11—11 of FIG. 10.

In order to secure the arrangement of the two-part panels of the type illustrated in FIG. 9, keyways 38 (FIG. 10) are provided on the respective surfaces 114,115 of the two abutting panel members 36,37. The keyways 38 are adapted for receiving a key member 41, as shown in FIGS. 10 and 11. The key member 41 provides a number of grooves 42 for enabling a lock-fit engagement of member 41 with the keyways 38. Opposed pairs of keyways 38 may be provided at vertically spaced apart intervals along the surfaces of the two-part corner members 36,37. In this manner, a corresponding plurality of key members 41 may secure the connection of the corner panel members of the type described in FIG. 9.

AIthough the concrete forming surfaces 2, 109, 110, 112 and 113 of the various panel members have been described as being planar, it will be appreciated by those skilled in this art that other types of mold surfaces may also be provided. For instance, the concrete forming surfaces of the panels may embody serrations or other indentations therein in order to impart a textured appearance to the set concrete. Furthermore, the corners 104,105 of the corner panel members described abcve need not necessarily be squared, but may be provided in other configurations, for instance a plurality of vertical surfaces to give a faceted corner construction to the concrete to be poured.

Referring now to FIGS. 12 to 16, there is shown a slotted guide means 45 for releasably retaining a locking key member 3, Which locking member secures two adjacent panel members 1 together. The slotted guide means 45 is formed by the superposition of two communicating open slots respectively provided in the flange members 6,7 of two adjacent panel members 1. The slotted guide means 45 is preferably formed by two slot segments 46,47 (FIG. 13*a*), the first slot segment 46 being open to the rear portion of the panel members and disposed substantially transverse to the front facings 2 thereof. The second slot seqment 47 of the slotted guide means is substantially perpendicular to the first slot segment 46, to thereby form an upwardly extending tongue portion 48 in the lip members 8,9 of flange members 6,7 of two adjacent panel members 1 for slidable cooperation with a said locking member 3 as desoribed below.

Locking key member 3 is provided with a slot 49 therein for receiving the upwardly extending tongue portion 48 formed by two adjacent lip members 8,9. As shown particularly in FIGS. 13*a* and 13*b*, locking key member 3 is slidably received into the first slot segment 46, whereupon locking key member 3 is then drop-fitted around the extending tonque portion 48 of the two adjacent lip members 8,9. The downward drop-fit engagement of a locking key member is arrested by the action of the two longitudinal fins 12 located adjacent the lower extremity of the second slot segment 47. It is to be noted that a plurality of slotted quide means 45 provided in the two abutting flange members 6,7 of the panel members 1 are preferably vertically spaced apart at intervals along the length of said flange members so as to better secure the connection of adjacent panel members by locking key members 3.

The rear portions 50 of locking key members 3 provide a web portion 51 or the like which is adapted to be received into a vertical slot 52 (FIG. 1) of a waler member 53. The waler member 53 is an elongate angle bracket or the like, having a series of horizontally spaced apart vertical slots 52 for engagement with a plurality of horizontally adjacent locking key members 3. The waler members 53 may be used wherever desired or necessary to provide increased structural integrity and riqidity to an assembled concrete forming structure.

Figure 15A:
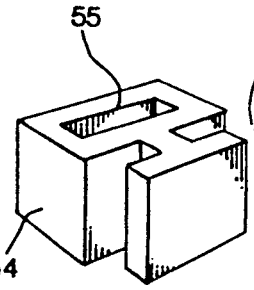
FIGS. 15*a*, 15*b* and 15*c* are perspective views illustrating three additional embodiments of a locking key member for use with the slotted guide means of the panel members depicted in FIGS. 12 to 14.
Figure 15B:
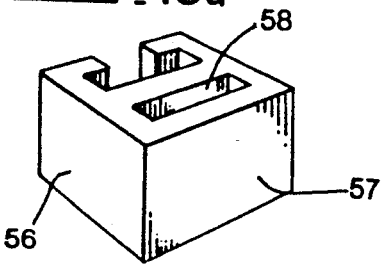
Figure 15C:
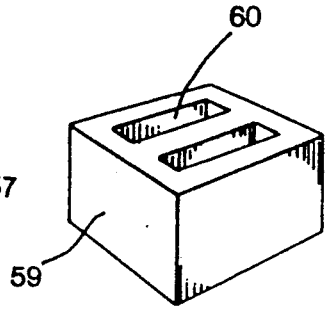

FIGS. 15*a* to 15*c* show additional embodiments for a locking key member. For instance, the member 54 has a similar construction to locking key member 3, but has a closed receiving slot 55 as opposed to the open receiving slot 49 of the latter member. Member 56, on the other hand. provides a similar open receiving slot configuration, but the rear portion 57 thereof is provided with a closed slot 58 for receiving those portions of waler member 53 which are disposed between any two adjacent closely spaced vertical slots 52 therein. Finally, member 59 is similar to member 56. with the exception that its front receiving slot 60 for the extending tongue portion 48 of the flange members 6,7 of the panel members is a closed slot as that provided in tbe case of member 54.

Figure 12:
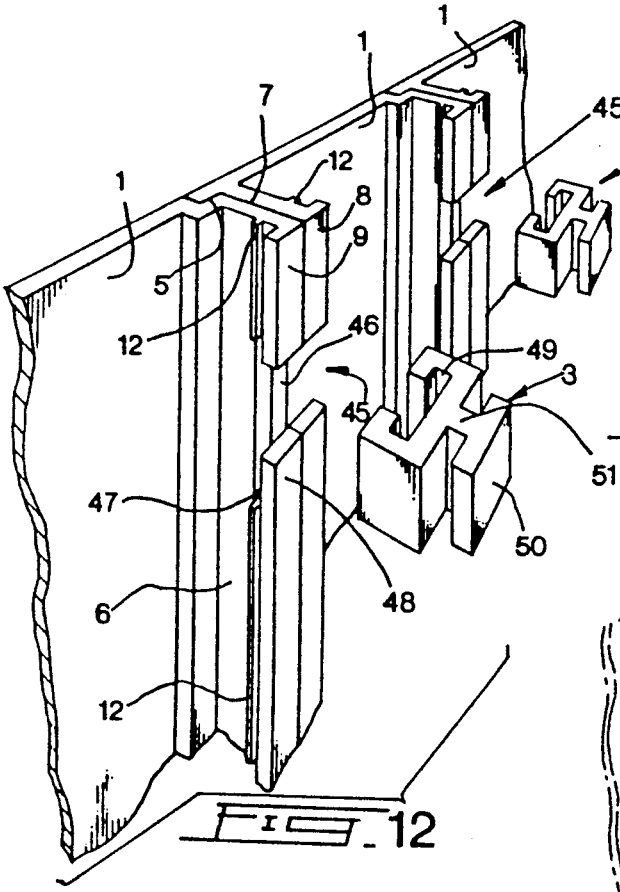
FIG. 12 is a perspective view showing a number of abutting straight-line panel members, wherein slotted guide means are provided in the flange members thereof for releasably retaining a locking key member therefor in drop-fit engagement.
Figure 13A:
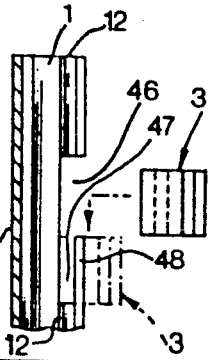
FIG. 13*a* is an end view of the panel members illustrated in FIG. 12 with a locking key member therefor, the locking key member shown in dotted lines being inserted into a slotted guide means of said panel members.
Figure 13B:
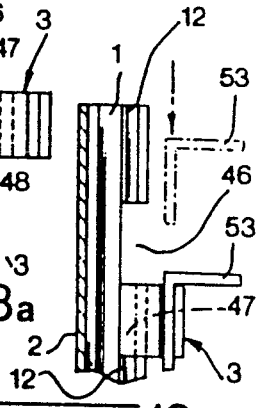
FIG. 13*b* is an end view of the panel members illustrated in FIG. 12, wherein a locking key member is shown inserted into a slotted guide means of the panel members and wherein an angled waler member is illustrated for connecting a plurality of horizontally adjacent locking key members, the said waler member prior to enqagement therewith being shown in dotted lines.
Figure 14:
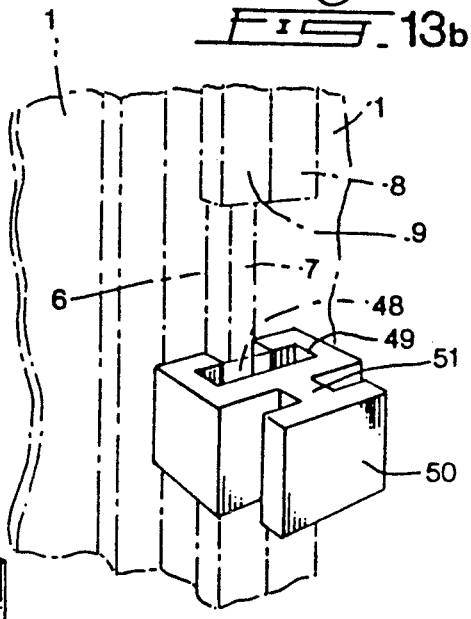
FIG. 14 is a detailed perspective view of a portion of the panel members illustrated in FIGS. 12 and 13, wherein the abutting panel members and slotted guide means formed thereby are shown in dotted lines and an inserted locking key member is depicted in full lines.
Figure 16:
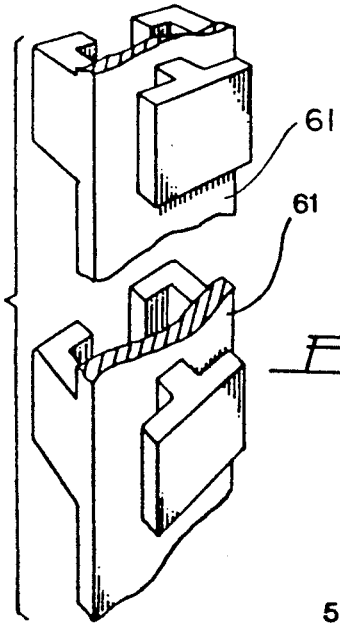
FIG. 16 is a partially sectioned perspective view of an elongate locking key member for engagement with a plurality of vertically spaced apart slotted guide means along two adjacent panel members.

FIG. 16 illustrates an elongate locking key member 61 which is intended to be inserted in a plurality of slotted guide means 45 which are vertically spaced apart along two adjacent panel members of the type descrihed in FIGS. 12 to 14. The use of the elongate version 61 for the locking key members is extremely advantageous in that two adjacent panels may be secured together in a single operation without having to proceed to the individual drop-fit engagement of a number of locking key members 3. This permits the workman at the building site to assemble a concrete pouring structure with greater efficiency and ease of operation.

Referring now to FIGS. 17 to 23, there is shown an alternative embodiment for the slotted guide means and locking key member described above. Inthis embodiment, a slotted guide means 61 is provided (FIG. 18*a*), once again having a first slot segment 63 generally transverse to the front facing 2 of the panel members 1 and being open to tbe rear portion of the panel members, with a second slot seqment 64 which is perpendicular to the first slot segment 63, to thereby form an offset and upwardly extending tongue portion 65 in the lip members 8,9 of flange members 6,7. The upper terminal end 66 of the offset tongue portion 65 extends entirely from that portion of flange member 7 and its lip member 9 which is disposed below the first slot segment 63 of slotted guide means 61. In his manner, a substantially planar surface 67 is formed at the upper terminal end of flange portion 6 and its lip member 8 adjacent the lower end of the second slot segment 64. Offset tongue portion 65 is notched as at 68 so as to form at the terminal end 66 thereof an overhanging transverse protrusion 69.

The slotted guide means 61 described above is adapted for receiving a resilient key member 62. The resilient key member 62 provides, at the front portion thereof, a qenerally U-shaped broad slot 70 whose lateral sides 71 are adapted for slip-fit engagement with the lateral walls 121 of flange members 6,7 of the panel member 1. The front and generally U-shaped portion of resilient key member 62 is attached to the rear portion 73 thereof hy means of a resilient connecting wall 72 or the like.

The resilient key member 62 is first received in the slotted guide means 61 in the first slot segment 63 thereof the U-shaped broad slot 70 of the resilient key member slidably engaging with the lateral walls 121 of the flange members 6,7. When key member 62 is engaged as described, the rear portion 73 thereof is urged away from the front portion thereof as shown by tbe dotted lines in pigure 20 so as to enable the drop-fit reception of the key member into the second slot segment 64 of the slotted guide means 61. So urged. the resilient wall 72 and rear portion 73 of the key member 62 clear the transverse protrusion 69 of the offset tongue 65 of the flange portion 6, so that the key member 62 drops down the slotted guide means 61 to be arrested in part by surface 67 and in part by the fins 12. Rear portion 73 of the key member may then be released to thereby securely engage the key member in the slotted guide means 61, the upward movement thereof being prevented by the overhanging transverse protrusion 69 thereabove.

Figures 17, 18A, 18B, 19, 20, 21, 22, 23:
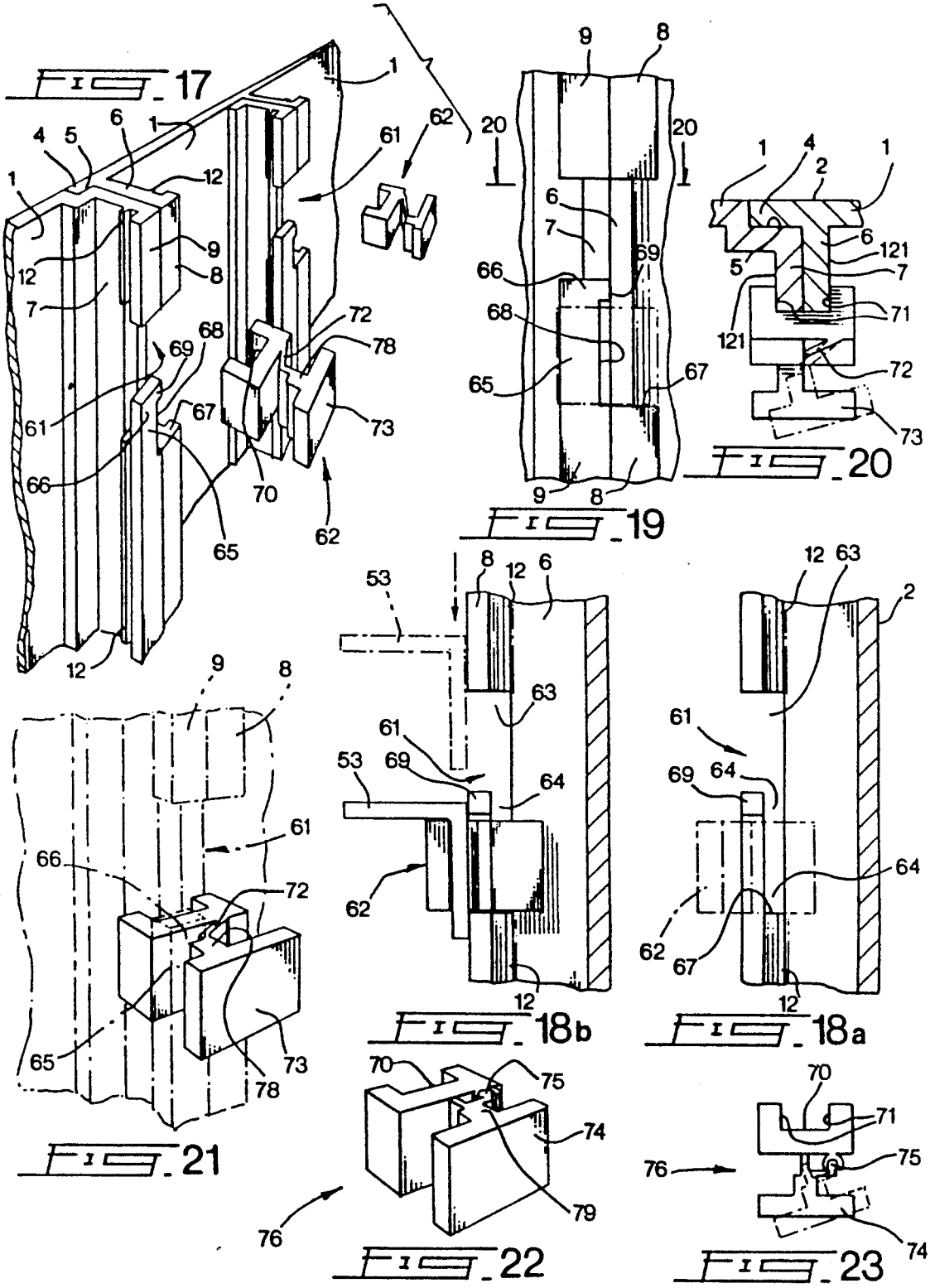
FIG. 17 is a perspective view showing a number of abutting straight-line panel members, wherein a second embodiment for slotted guide means and for resilient key members therefor is depicted.
FIG. 18*a* is an end view of the panel members illustrated in FIG. 17 with a resilient key member therefor, the resilient key member shown in dotted lines being inserted into a slotted guide means of said panel members.
FIG. 18*b* is an end view of the panel members illustrated in FIG. 17, wherein a resilient key member is shown inserted into a slotted guide means of the panel members and wherein an angled waler member is illustrated for connecting a plurality of horizontally adjacent resilient key members, the said waler member prior to engagement therewith heing shown in dotted lines.
FIG. 19 is an elevational view of the slotted guide means and resilient key member of FIGS. 18*a* and 18*b*.
FIG. 20 is a partially sectioned top plan view of an inserted resilient key member, taken alonq line 20—20 of FIG. 19 and shown in full lines, wherein the rear portion of said key member, shown in dotted lines, has been urged in an open position for enabling reception into said slotted guide means.
FIG. 21 is a detailed perspective view of the slotted guide means formed by two adjacent panel members for the embodiment illustrated in FIGS. 17 to 20, wherein the abutting panel members and slotted quide means formed thereby are shown in dotted lines and an inserted resilient key member therein is depicted in full lines.
FIG. 22 is a perspective view of a second embodiment of a locking key member for use with the slotted guide means illustrated in FIGS. 17 to 21, wherein the rear portion of said key member is hinged to the front portion thereof.
FIG. 23 is a plan view of the key member of FIG. 22, wherein an open position of the key member is shown in dotted lines.

FIGS. 22 and 23 show a hinged key member 76 having a front portion thereof of similar construction to the resilient key member 62, but whose rear portion thereof is hinged as at 75 to permit reception in the slotted guide means described above with respect to FIGS. 17 to 21. In this particular embodiment of the hinged key member, a stopper 67 is provided for arresting the forward movement of rear portion 74 of the member.

It is to be noted that each of the key members 62,76 respectively provides a web portion 78,79 thereon for slidable engagement with the horizontally spaced apart vertical slots 52 of a waler member 53, as described above.

Figure 24:
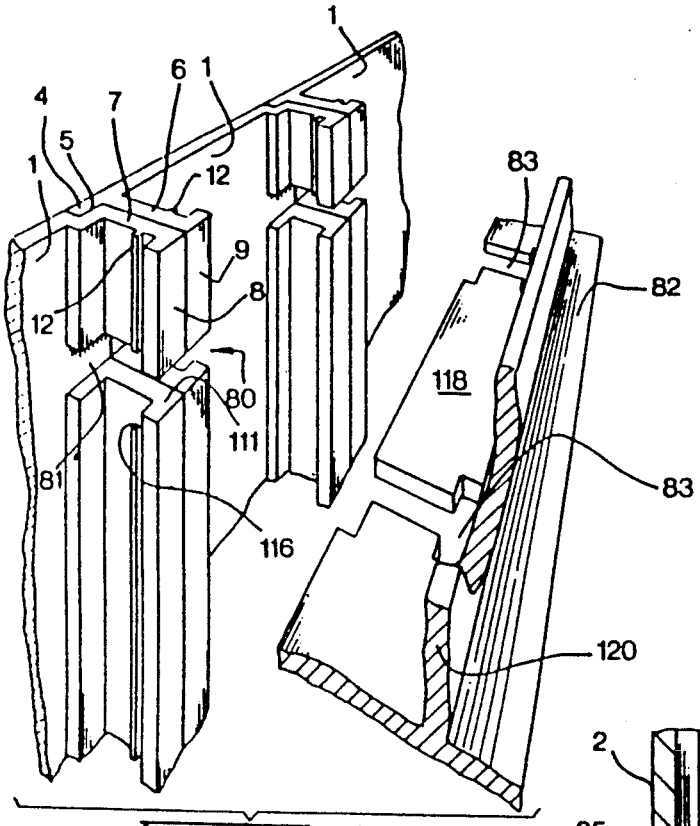
FIG. 24 is a perspective view showing a number of abutting straight-line panel members, wherein a third embodiment of a slotted guide means and a locking member therefor is depicted.
Figure 25:
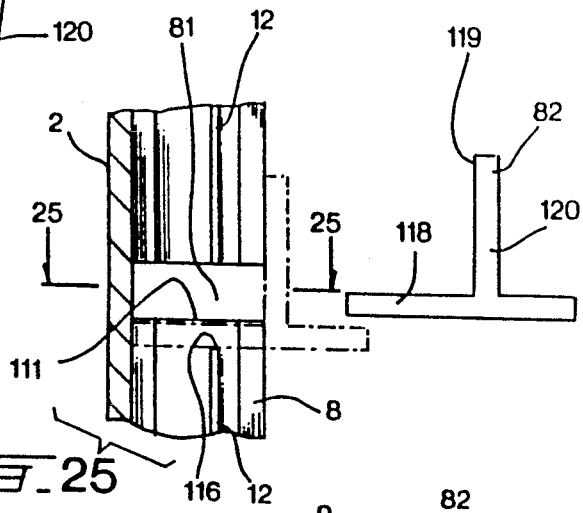
FIG. 25 is an end view of the slotted guide means and locking member of FIG. 24, wherein an inserted locking member is shown in dotted lines.
Figure 26:
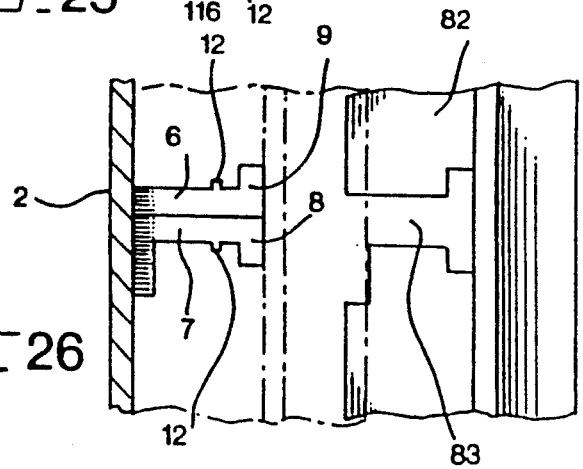
FIG. 26 is a partially sectioned top plan view of the slotted guide means and locking member of FIGS. 24 and 25, taken along line 26—26 of FIG. 25.
Figure 27:
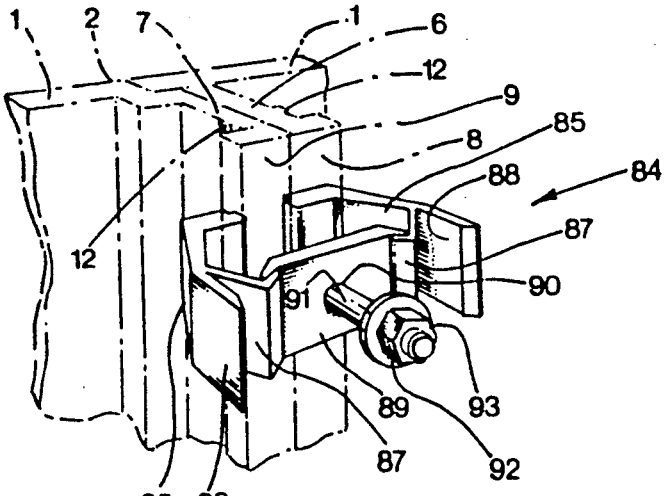
FIG. 27 is a detailed perspective view of two abutting straight-line panel members, showing a locking clamp member for securing said panel members toqether.
Figure 28:
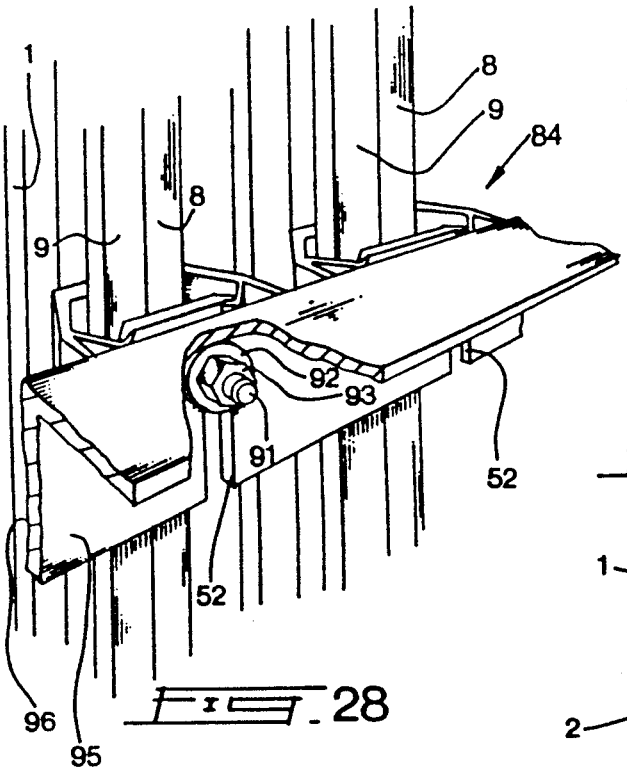
FIG. 28 is a detailed perspective view of two horizontally adjacent locking clamp members as shown in FIG. 27, said members being interconnected by means of an angled waler member.
Figure 29:
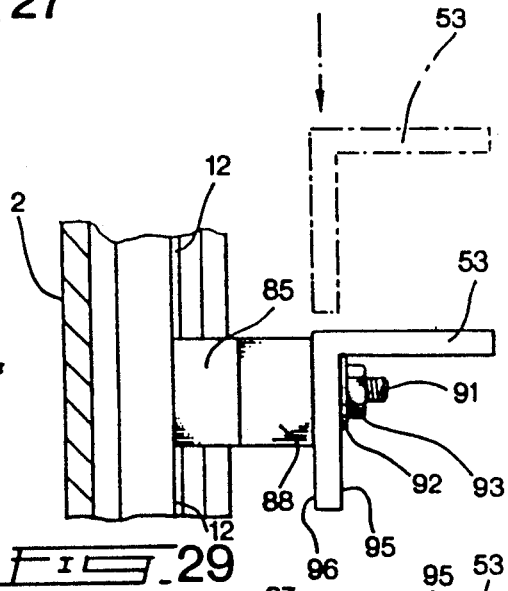
FIG. 29 is an end view of the panel members and locking clamp member shown in FIG. 27 with an angled waler member received thereon, the said waler member prior to engagement therewith being shown in dotted lines
Figure 30:
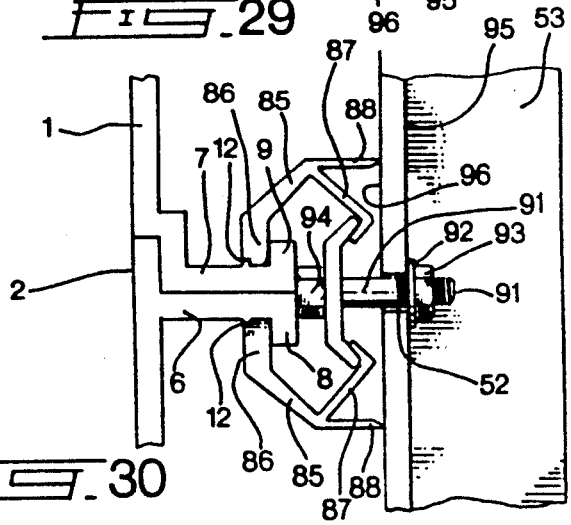
FIG. 30 is a bottom plan view of the panel members and locking clamp member of FIG. 29 with a waler member received thereon.
Figure 31:
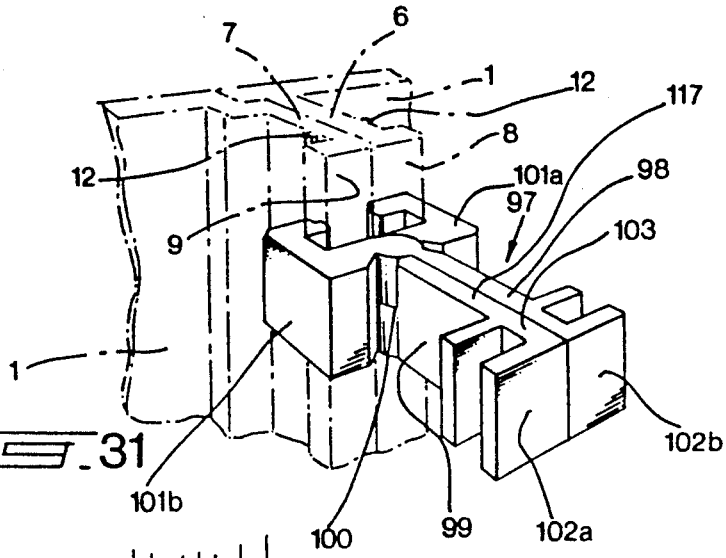
FIG. 31 is a detailed perspective view of two abutting panel members having a locking soissor member for seouring said panel members together.
Figure 32:
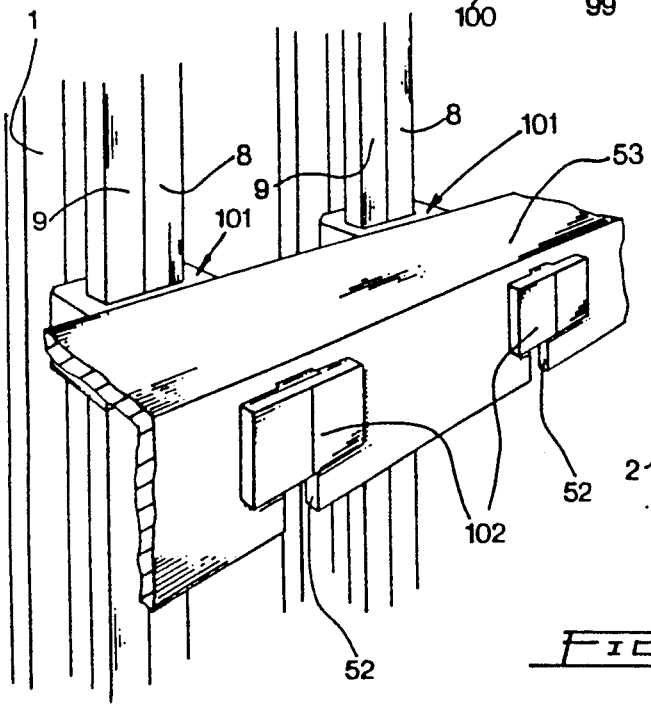
FIG. 32 is a perspective view showing two horizontally adjacent locking scissor members of the type illustrated in FIG. 31, said members being interconnected by means of an angled waler member.
Figure 33:
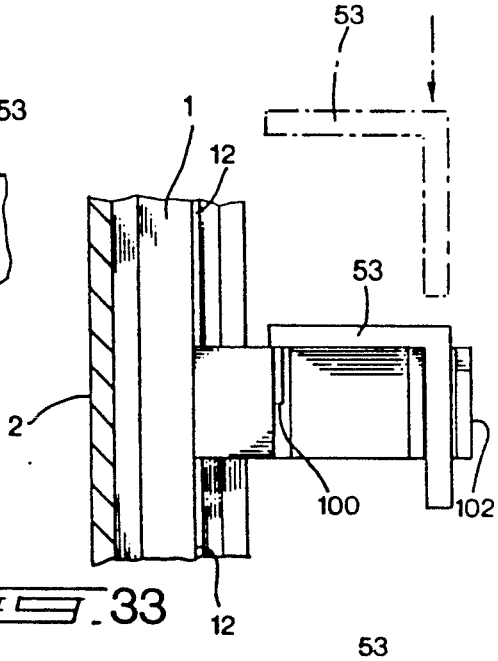
FIG. 33 is an end view of the panel members and locking scissor member as shown in FIG. 31, with an angled waler member being received thereon, the said waler member prior to engagement therewith being shown in dotted lines.
Figure 34:
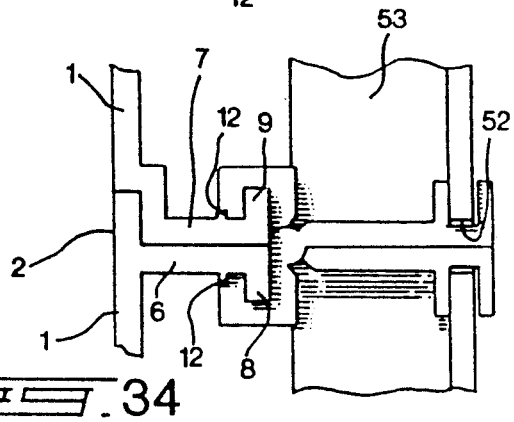
FIG. 34 is a bottom plan view of the panel members and looking scissor member shown in FIG. 33, with a wale member received thereon.

Turning now to FIGS. 24 to 26, there is illustrated yet another slotted guide means 80 for receiving a locking member for the abutting modular panels 1 of the present invention. In this specific emhodiment, the slotted quide means 80 is composed of communicating horizontal slots 81 which are substantially transverse to the front facing 2 of the concrete pouring iorms. Slots 81 are adapted for receiving a T-shaped waler member 82 or the like. The waler member 82 comprises a horizontally disposed plate portion 118 and a vertical member 120 extending therefrom. A plurality of oontoured apertures 83 may be provided in a horizontally spaced apart configuration on the plate portion 118 of the Waler member, said apertures each matching the cross sectional profiles of the flange members 6,7 and lip members 8,9 of the panel members 1, with the exception of the cross sectional profiles of the two longitudinal fins 12 provided on the said flange members, whose specific contours are not reproduced in apertures 83.

In order to secure the panel members hy means of the locking member 82, the said locking member is first inserted into horizontal slots 81, the contoured apertures 83 thereof permitting member 82 to drop down in intimate slip fit engagement with the flange members 6,7. The downward movement of member 82 is arrested hy fins 12 as shown in FIG. 25, the upper terminal ends 116 of said fins being offset vertically from the upwardly facing surfaces 111 of the flange members 6,7 so as to prevent the rearward movement of the locking member 82 by means of the lip members 8,9. The front surface 119 of the vertical member 120 of the locking member 82 is adapted for abutment with a rear portion of the flange members 6,7 when the locking member is received in slots 81.

FIGS. 27 to 30 illustrate a oIamp type of Iooking member ior two adjacent panel members of the type disclosed in FIGS. 1, 2 and 3. The clamp member 84 is preferably composed of three cooperating sections. Two of such sections of the clamping member 84 are symmetrical side elements 85, which each comprise a front clamping portion 86 suitably contoured to engage with the flange members 6,7 of the panel members I adjacent the longitudinal fins 12 thereof and the lip members 8,9 provided thereon. The rear portions of the side elements 85 each provide two diverging members 87,88. The rear terminal members 88 extend rearwardly of said clamp member 84 and are adapted to abut against the front surface 96 of a waler member 53. Central hook members 87, on the other hand, are adapted to engaqe with the third element of the clamping member 84, namely a central plate member 89. The central plate member 89 is provided with an aperture 90 centrally disposed thereon and adapted for receiving a bolt 91 or the like.

The operation of clamping member 84 is as follows. Bolt 91 is adapted for slidable reception in the horizontally spaced apart vertical slots 82 of waler member 53. When inserted into said slots, the bolts 91 may be secured therein by means of a nut and washer assembly 92,93. By tightening nut 93 and hence washer 92 against the rear surface 95 of the waler member 53, the head 94 of bolt 91 urges central plate member 89 away from the lip members 8,9 of the panel members 1, to thereby exert a clamping pressure at the front portions 86 of the side elements 85. This clamping action is effected by means of a slightly divergent movement of the rear terminal members 88 along the surface 96 of waler member 53 as the nut 93 is tightened, caused by the similarly divergent movement of hook members 87 towards the said surface 96.

It is to be noted that the clamp type memhers 84 are especially advantaqeous ior use with the panel members according to the present invention in that a slotted guide means need not be provided in the flange members ef said panel members.

FIGS. 31 to 34 show yet another embodiment ior a clamping member according to the present invention. The scissor member 97 is an assembly having two symmetrical members 98,99, opposed notches 100 being provided in eacb member to permit some degree of scissor-type engagement of said members. The clamping member 97 generally comprises a front portion 101 which is contoured to engage with the longitudinal fins 12 and lip members 8,9 of the flange members 6,7 of the panel members 1. The locking member 97 further provides a rear portion 102 thereof which includes a web portion 103 adapted for reception in the horizontally spaced apart vertical slots 52 of a waler member 53. Once again, the advantage of using scissor members 97, as is the case with the clamping member 84 discussed above, is that there is no necessity to provide a plurality of slotted guide means in the rear portions of the panel members 1.

The scissor member 97 may be secured by first engaging teh front portion 101*a* of member 99 thereof around the lip member 8 of flange member 6. Member 98 of the scissor member 97 may then be lowered onto member 99 thereof and joined thereto at the opposed notches 100 provided in each of said members, the front portion 101 of member 97 being held agape. Member 98 may subsequently be pivoted about notches 100 to bring the front portion 101*b* thereof into engagement around lip member 9 of flange member 7. Once so secured, a waler member such as 52 may be supported on the substantially planar top surface 117 of the scissor member 97.

As will be appreciated by those skilled in this art, various modifications of detail may be made to the embodiments described herein without departing from the scope of the present invention which is limited only by the following claims.

The embodiments of the invention inwhich an exlcusive property or privilege is claimed are defined as follows:

1. A modular assembly for poured conrete forming, said assembly comprising a plurality of interconnecting rigid panel members and releasable locking members therefor, said panel members and said locking members each being integrally formed; said panel members having a rear portion thereof and a front facing for contact with poured concrete to form a mold surface therefor; said rear portion of the panel members providing at least two flange members extending generally rearwardly of said front facing, each of said flange members being longitudinally disposed respectively adjacent each of at least two opposed terminal edges of the said panel members; said panel members, adjacent said front facing, further providing a stepped portion at one of said terminal edges thereof, and a corresponding protruding edge portion at the other of said terminal edges thereof for intimate engagement with the said stepped portion of an abutting panel member; each of the said flange members providing a mating surface for abutment in intimate contact with an adjacent flange member of an abutting panel member, each of said flange members further providing receiving means for releasably retaining a said locking member for securing two abutting panel members of said assembly, said receiving means comprisign a slotted guide means for releasably retaining a said locking member in slip-fit engagement, said guide means being formed by the superposition of two communicating slots respectively provided in said adjacent flange members of two abutting panel members, said slots being generally L-shaped and each comprising first and second slot segments, said first slot segment being open to the rear portion of said panel members and extending generally towards the said front facing thereof, said second slot segment communicating with said first slot segment and being disposed in a direction substantially parallel to the front facing of said panel members.

2. The modular assembly for poured concrete forming according to claim 1, wherein said panel members are elongate and are connectable in an edge-to-edge upstanding configuration.

3. The modular assembly for poured conrete forming according to caim 2, wherein said first slot segment is substantially transverse to the front facing of said panel members and said second slot segment is substantially perpendicular to the first slot segment, to thereby form an upwardly extending tongue portion in at least one of said adjacent flange members of two abutting panel members for slidable drop-fit engagement with a said locking memer.

4. The modular assembly for poured conrete forming according to claim 3, wherein said locking member is a key member having a slot therein for receiving said extending tongue portion of said adjacent flange members of the panel members.

5. The modular assembly for poured concrete forming according to claim 3, wherein said locking member provides means for engagement to a waler member, said waler member constituting means for connecting a plurality of horizontally adjacent locking members each respectively disposed in drop-fit engagement with a corresponding plurality of slotted guide means of abutting panel members.

6. The modular assembly for poured concrete forming according to claim 5, wherein a plurality of vertically spaced apart slotted guide means are provided along the length of said adjacent flange members of two abutting panel members.

7. The modular assembly for poured concrete forming according to claim 6, wherein a single key member is provided for simultaneous engagement with a said plurality of vertically spaced apart slotted guide means.

8. The modular assembly for poured concrete iorming according to claim 3, wherein the said upwardly extending tongue portion provides stop means for arresting the upward movement of a locking member received in said slotted guide means, said locking member having a front portion and a rear portion thereof connected to said front portion, said front portion having slot means therein for slidably receiving the said adjacent flange members of two abutting panel members adjacent said first slot segment, said rear portion being displaceable from said front portion so as to enable the drop-fit engagement of said locking member in said second slot segment while clearing the said stop means of said tongue portion.

9. The modular assemhly for poured ccncrete forming according to claim 8, wherein said rear portion of said locking member is resiliently connected to said front portion thereof.

10. The modular assembly for poured concrete forming according to claim 9, wherein said locking member provides means for engagement to a waler member.

11. The modular assembly for poured concrete forming according to claim 11, wherein said adjacent flange members of two abutting panel members each includes a longitudinally extending lip member thereon adjacent the free terminal ends thereof, said lip members being disposed substantially parallel to the front facing of said panel members to thereby form a generally T-shaped cross-sectional configuration for said adjacent flange members, said upwardly extending tongue portion being formed at least partially by said lip members.

12. The modular assembly for poured concrete forming according to claim 11, wherein said upwardly extending tongue portion is offset, being formed at least partially by only one of said lip members of said adjacent flange members, said tongue portion having stop means for arresting the upward movement of a locking member received in said slotted guide means, said stop means comprising an overhanging portion of said tongue portion disposed at the tree terminal end thereof, said overhanging portion extending generally in a direction substantially parallel to the front facing of said panel members, said locking member having a front portion and a rear portion thereof, said rear portion being resiliently connected to said front portion, said front portion having slot means therein for slidably receiving the said adjacent flange members of two abutting panel members adjacent said first slot segment, said rear portion being resiliently displaceahle from said front portion so as to enable the drop-fit engagement of said locking member in said second slot segment while clearing the said overhanging portion of said tongue portion.

13. A modular assembly for poured concrete forming, said assembly comprising a plurality of itnerconnecting rigid panel members and releasable locking members therefor, said panel members having a rear portion thereof and a front facing for contact with poured concrete to form a mold surface therefor; said rear portion of the panel members providing at least two flange members extending generally rearwardly of said front facing, each of said flange members being longitudinally disposed respectively adjacent each of at least two opposed terminal edges of the said panel members; said panel members, adjacent said front facing, further providing a stepped portion at one of said terminal edges thereof, and a corresponding protruding edge portion at the other of said terminal edges thereof for intimate engagement with the said stepped portion of an abutting panel member; each of the said flange members providing a mating surface for abutment in intimate contact with an adjacent flange member of an abutting panel member, each of the said flange members further providing a slotted guide means for releasably retaining a said locking member in slip-fit engagement for securing two abutting panel members of said assembly, said guide means being formed by the superposition of two communicating slots respectively provided in said adjacent flange members of two abutting panel members, said slots being generally L-shaped and comprising first and second slot segments, said first slots egment being open to the rear portion of said panel members and extending generally towards the said front facing thereof, said second slot segment communicating with said first slot segment and being disposed in a direction substantially parallel to the front facing of said panel members.

14. The modular assembly for poured concrete forming according to claim 13, wherein said panel members are elongate and are connectable in an edge-to-edge upstanding configuration.

15. The modular assembly for poured concrete forming according to claim 14, wherein said first slot segment is substantially transverse to the front facing of said panel members and said second slot segment is substantially perpendicular to the first slot segment, to thereby form an upwardly extending tongue portion in at least one of said adjacent flange members oftwo ahutting panel members tor slidable drop-fit engagement with a said locking member.

16. The modular assembly for poured concrete forming according to claim 15, wherein said locking member is a key member having a slot therein for receiving said extending tongue portion of said adjacent flange members of the panel members.

17. The modular assembly for poured concrete forming according to claim 15, wherein said locking member provides means for engagement to a waler member, said waler memher constituting means for connecting a plurality of horizontally aligned adjacent Iooking members each respectively disposed in drop-fit engagement with a corresponding plurality of slotted guide means of abutting panel members.

18. The modular assembly for poured concrete forming according to claim 17, wherein a plurality of vertically spaced apart slotted guide means are provided along the length of said adjacent flange members of two abutting panel members.

19. The modular assembly for poured concrete forming according to claim 18, wherein a single key member is provided for simultaneous engagement with a said plurality of vertically spaced apart slotted guide means.

20. The modular assembly for poured concrete forming according to claim 15, wherein the said upwardly extending tongue portion provides stop means for arresting the upward movement of a locking member received in said slotted guide means, said locking member having a front portion and a rear portion thereof connected to said front portion, said front portion having slot means therein for slidably receiving the said adjacent flange members of two abutting panel members adjacent said first slot segment, said rear portion being displaceable from said front portion so as to enable the drop-fit engagement of said locking member in said second slot segment while clearing the said stop means of said tongue portion.

21. The modular assembly for poured concrete forming according to claim 20, wherein said rear portion of said locking member is resiliently connected to said front portion thereof.

22. The modular assembly for poured concrete forming according to claim 21, wherein said locking memher provides means for engagement to a waler member.

23. The modular assembly for poured concrete forming according to claim 20, wherein said rear portion of said locking member is pivotally connected to said front portion thereof.

24. The modular assembly for poured concrete forming according to claim 23, wherein said locking member provides means for engagement to a waler member.

25. The modular assembly for poured concrete forming according to claim 15, wherein said adjacent flange members of two abutting panel members each includes a longitudinally extending lip member thereon adjacent the free terminal ends thereof, said lip members being disposed substantially parallel to the front facing of said panel members to thereby form a generally T-shaped cross-sectional configuration for said adjacent flange members, said upwardly extending tongue portion being formed at least partially by said lip members.

26. The modular assembly for poured concrete forming according to claim 32, wherein said upwardly extending tongue portion is offset, being formed at least partially by only one of said lip members of said adjacent flange members, said tongue portion having stop means for arresting the upward movement of a locking member received in said slotted guide means, said stop means comprising an overhanging portion of said tongue portion disposed at the free terminal end thereof, said overhanging portion extending generally in a direction substantially parallel to the front facing of said panel members, said locking member having a front portion and a rear portion thereof, said rear portion being resiliently connected to said front portion, said front portion having slot means therein for slidably receiving the said adjacent flange members of two abutting panel members adjacent said first slot segment, said rear portion being resiliently displaceable from said front portion so as to enable the drop-fit engagement of said Iooking member in said second slot segment while olearing the said overhanging portion of said tongue portion.

27. A modular assembly for poured concrete forming, said assembly comprising a plurality of interconnecting rigid panel members and releasable locking members therefor; said panel members having a rear portion thereof and a front facing for contact with poured concrete to form a mold surface therefor; said rear portion of the panel members providing at least two flange members extending generally rearwardly of said front facing, each of said flange members being longitudinally disposed respectively adjacent each of at least two opposed temrinal edges of the said panel members to thereby form a mating surface for abutment in intimate contact with an adjacent mating surface of an abutting panel member; each of said flange members further providing receiving means for releasably retaining a said locking member for securing two abutting panel members of said assembly; wherein said receiving means comprises a slotted guide means for releasably retaining a said locking member in slidable drop-fit engagement therewith, said guide means being formed by the juxtaposition of two communicating slots respectively provided in said adjacent flange members of two abutting panel members, each of said slots being open to the rear portion of said panel members, said slots commencing in a direction extending generally towards the said front facing of said panel members and terminating in a direction substantially parallel to the front facing of said panel members.

* * * * *